US008685913B2

(12) United States Patent
Warkotsch et al.

(10) Patent No.: US 8,685,913 B2
(45) **Date of Patent: *Apr. 1, 2014**

(54) DETERGENT HAVING AN ACTIVE INGREDIENT THAT IMPROVES THE PRIMARY DETERGENCY

(75) Inventors: Nadine Warkotsch, Duesseldorf (DE); Birgit Middelhauve, Monheim (DE); Marc-Steffen Schiedel, Duesseldorf (DE); Konstantin Benda, Duesseldorf (DE)

(73) Assignee: Henkel AG & Co. KGAA, Duesseldorf (DE)

( * ) Notice: Subject to any disclaimer, the term of this patent is extended or adjusted under 35 U.S.C. 154(b) by 925 days.

This patent is subject to a terminal disclaimer.

(21) Appl. No.: 12/569,185

(22) Filed: Sep. 29, 2009

(65) Prior Publication Data

US 2010/0016206 A1 Jan. 21, 2010

Related U.S. Application Data

(63) Continuation of application No. PCT/EP2008/054003, filed on Apr. 3, 2008.

(30) Foreign Application Priority Data

Apr. 3, 2007 (DE) ..... 10 2007 016 382
May 21, 2007 (DE) ..... 10 2007 023 870
Aug. 14, 2007 (DE) ..... 10 2007 038 455

(51) Int. Cl.
*C11D 3/26* (2006.01)
*C11D 3/37* (2006.01)
*C11D 1/00* (2006.01)

(52) U.S. Cl.
USPC ..... 510/466; 510/336; 510/337; 510/356; 510/357; 510/475; 510/499; 510/500; 510/504; 8/137

(58) Field of Classification Search
USPC ..... 510/336, 337, 356, 357, 466, 475, 499, 510/500, 504; 8/137
See application file for complete search history.

(56) References Cited

U.S. PATENT DOCUMENTS

| | | | | |
|---|---|---|---|---|
| 3,367,920 | A | 2/1968 | Wasserman et al. | |
| 3,893,929 | A | 7/1975 | Basadur | |
| 4,000,093 | A | 12/1976 | Nicol et al. | |
| 4,116,885 | A | 9/1978 | Derstadt et al. | |
| 4,136,038 | A | 1/1979 | Pracht et al. | |
| 4,174,305 | A | 11/1979 | Burns et al. | |
| 4,201,824 | A | 5/1980 | Violland et al. | |
| 4,664,839 | A | 5/1987 | Rieck | |
| 5,534,182 | A | 7/1996 | Kirk et al. | |
| 5,622,926 | A | 4/1997 | Schade et al. | |
| 5,643,581 | A | 7/1997 | Mougin | |
| 6,395,265 | B1 | 5/2002 | Mougin | |
| 8,044,016 | B2 * | 10/2011 | Warkotsch et al. | 510/427 |
| 2003/0158064 | A1 | 8/2003 | Kessler et al. | |
| 2003/0198819 | A1 | 10/2003 | Reusmann | |
| 2004/0034911 | A1 | 2/2004 | Day | |
| 2007/0092656 | A1 | 4/2007 | Keul | |
| 2008/0075683 | A1 | 3/2008 | Herzig | |
| 2009/0232752 | A1 | 9/2009 | Carson | |
| 2010/0011513 | A1 | 1/2010 | Warkotsch et al. | |
| 2010/0011519 | A1 | 1/2010 | Warkotsch et al. | |
| 2010/0016203 | A1 | 1/2010 | Warkotsch et al. | |
| 2010/0022427 | A1 | 1/2010 | Warkotsch et al. | |
| 2010/0022428 | A1 | 1/2010 | Warkotsch et al. | |
| 2010/0028270 | A1 | 2/2010 | Nguyen-Kim | |

FOREIGN PATENT DOCUMENTS

| | | | |
|---|---|---|---|
| DE | 1617141 | A1 | 10/1965 |
| DE | 2200911 | A1 | 1/1971 |
| DE | 2253063 | A1 | 10/1971 |
| DE | 2412837 | | 10/1974 |
| DE | 2655551 | A1 | 6/1977 |
| DE | 2846984 | A1 | 5/1979 |
| DE | 2857292 | A1 | 2/1980 |
| DE | 3324258 | A1 | 1/1984 |
| DE | 42 44 386 | A1 | 6/1994 |
| DE | 10037126 | A1 | 2/2002 |
| DE | 100 50 622 | A1 | 5/2002 |
| DE | 103 57 232 | B3 | 6/2005 |
| EP | 0164514 | A1 | 11/1984 |
| EP | 0 185 427 | | 6/1986 |
| EP | 0 213 739 | A2 | 3/1987 |
| EP | 0 300 305 | A2 | 7/1987 |
| EP | 0 241 984 | A2 | 10/1987 |
| EP | 0 241 985 | A2 | 10/1987 |
| EP | 0 213 729 | | 11/1987 |
| EP | 0 213 730 | | 11/1987 |
| EP | 2 53 567 | A1 | 1/1988 |
| EP | 0 271 312 | A2 | 6/1988 |
| EP | 2 72 033 | A2 | 6/1988 |
| EP | 0 274 907 | A1 | 7/1988 |
| EP | 357280 | A2 | 3/1990 |
| EP | 0 634 486 | A1 | 1/1995 |
| EP | 1 541 568 | A1 | 6/2005 |
| GB | 1154730 | | 6/1969 |
| GB | 1377092 | | 12/1974 |
| GB | 2007692 | A | 5/1979 |
| GB | 1578930 | | 11/1980 |
| GB | 2165856 | | 4/1986 |
| WO | WO95/04805 | * | 2/1995 |
| WO | WO-97/09369 | A | 3/1997 |
| WO | WO 99/41347 | | 8/1999 |

(Continued)

OTHER PUBLICATIONS

International Search Report for Priority Application PCT/EP2008/054003, Dec. 2008.

*Primary Examiner* — Gregory Delcotto
(74) *Attorney, Agent, or Firm* — RatnerPrestia

(57) ABSTRACT

The invention provides improvements in the primary detergency of detergents for washing textiles, particularly against oily stains and/or stains containing fat. These improvements are realized through the use of certain polycarbonate-, polyurethane-, and/or polyurea-polyorganosiloxane compounds or precursor compounds usable in the production thereof having certain reactive groups.

14 Claims, No Drawings

(56) References Cited

FOREIGN PATENT DOCUMENTS

| | | | | |
|---|---|---|---|---|
| WO | WO 00/77138 | A1 | | 12/2000 |
| WO | WO-03/035712 | A1 | | 5/2003 |
| WO | WO 03/042264 | A2 | | 5/2003 |
| WO | WO 03/095530 | A1 | | 11/2003 |
| WO | WO 2005/042684 | A1 | | 5/2005 |
| WO | WO 2005/058863 | A1 | | 6/2005 |
| WO | WO 2006/005358 | A1 | | 1/2006 |
| WO | WO 2006/029794 | A1 | | 3/2006 |
| WO | WO2006/069742 | | * | 7/2006 |
| WO | WO 2006/069742 | A1 | | 7/2006 |
| WO | WO 2006/127882 | A2 | | 11/2006 |

* cited by examiner

DETERGENT HAVING AN ACTIVE INGREDIENT THAT IMPROVES THE PRIMARY DETERGENCY

CROSS-REFERENCE TO RELATED APPLICATIONS

This application is a continuation under 35 U.S.C. §§120 and 365(c) of International Application PCT/EP2008/054003, filed on Apr. 3, 2008, and published as WO 2008/141858 on Nov. 27, 2008. This application also claims priority under 35 U.S.C. §119 of DE 10 2007016382.9 filed Apr. 3, 2007, DE 10 2007023870.5, filed May 21, 2007, and DE 10 2007038455.8, filed Aug. 14, 2007. The disclosures of PCT/EP2008/054003, DE 10 2007016382.9, DE 10 2007023870.5, and DE 10 2007038455.8 are hereby incorporated by reference in their entirety for all purposes.

FIELD OF THE INVENTION

The present invention relates to the use of specific polycarbonate-, polyurethane- and/or polyurea-polyorganosiloxane compounds or useable precursor compounds used for their manufacture containing specific reactive groups in order to improve the primary washing power of laundry detergents towards oil and fat-containing soils when washing textiles.

DISCUSSION OF THE RELATED ART

Besides the indispensable ingredients, such as surfactants and builders for the washing process, laundry detergents generally comprise further constituents that can be summarized by the term detergent auxiliaries and which include the different active substances such as foam regulators, graying inhibitors, bleaching agents, bleach activators and color transfer inhibitors. These kinds of auxiliaries also include substances, whose presence boosts the washing power of surfactants, without themselves generally having to exhibit a pronounced surfactant behavior. Analogously, the same is true for cleaning agents for hard surfaces. These types of substances are often called washing power strengtheners or "fat boosters" due to their particularly pronounced action towards oil or fat-based soils.

BRIEF SUMMARY OF THE INVENTION

It has been surprisingly found that certain polycarbonate-, polyurethane-, and/or polyurea-polyorganosiloxane compounds or precursors of the type of the reactive cyclic carbonates and ureas employed for their manufacture have particularly good washing power strengthening properties.

DETAILED DESCRIPTION OF CERTAIN EMBODIMENTS OF THE INVENTION

The subject matter of the invention is the use of an active substance, selected from the polycarbonate-, polyurethane- and/or polyurea-polyorganosiloxane compounds, comprising at least one structural element of Formula (I):

$$—Y\text{-}A\text{-}(C{=}O)\text{-}A\text{-} \quad (I),$$

wherein each A is independently selected from S, O and $NR^1$,

Y is selected from di- or polysubstituted, especially tetrasubstituted straight chain, cyclic or branched, saturated, unsaturated or aromatic substituted or unsubstituted hydrocarbon groups containing up to 1000 carbon atoms (wherein the carbon atoms of an optionally comprised polyorganosiloxanes unit are not counted in), which can comprise one or more groups, selected from —O—, —(CO)—, —NH—, —$NR^2$—, —($N^+R^2R^3$)— and a polyorganosiloxane unit containing 2 to 1000 silicon atoms, $R^1$ is hydrogen or a straight chain, cyclic or branched, saturated, unsaturated or aromatic hydrocarbon group containing up to 40 carbon atoms which can comprise one or more groups, selected from —O—, —(CO)—, —NH— and —$NR^2$—, $R^2$ is a straight chain, cyclic or branched, saturated, unsaturated or aromatic hydrocarbon group containing up to 40 carbon atoms which can comprise one or more groups, selected from —O—, —(CO)— and —NH—, $R^3$ is a straight chain, cyclic or branched, saturated, unsaturated or aromatic hydrocarbon group containing up to 100 carbon atoms which can comprise one or more groups, selected from —O—, —(CO)— and —NH—, or is a divalent group that forms cyclic structures within the Y group, or one or both A groups neighboring Y can form a nitrogen-containing heterocyclic group with the group Y located between them, and in the overall compound not all of the groups A or Y or $R^1$ or $R^2$ or $R^3$ listed in Formula (I) have to be the same, with the proviso that in the overall compound at least one of the groups Y comprises a polyorganosiloxane unit having 2 to 1000 silicon atoms, or their acid addition compounds and/or salts in order to boost the primary washing power towards oil- and/or fat-containing soils when washing textiles.

Compounds of the general Formula (I) can be obtained by the reaction of diisocyanates, esters or amides of bis-chloroformic acid or phosgene with the thiols, alcohols or amines that contain the structural element Y. In order to obtain polymeric structures these starting compounds possessing the structural element Y have at least 2 of the cited functional groups. Compounds that otherwise correspond to the structural element Y, but are only monofunctional, can be considered as the end groups.

Preferred polycarbonate- and/or polyurethane-polysiloxane compounds include those that comprise at least one structural element of Formula (II) or (III):

$$\text{-A-Y-A-(CO)—O-Z-(CHOH)-Z-O—(CO)—} \quad (II),$$

$$\text{-A-Y-A-(CO)—O—(CH}_2\text{OH)-Z-O—(CO)—} \quad (III),$$

in which A and Y have the abovementioned meanings and

Z is selected from the divalent, straight chain, cyclic or branched, saturated or unsaturated, optionally substituted hydrocarbon groups containing 1 to 12 carbon atoms. These structural elements can be obtained by ring opening cyclic carbonates (carbonic acid esters of vicinal diols) with the structural element Y-containing thiols, alcohols or amines.

The polycarbonate-, polyurethane- and/or polyurea-polyorganosiloxane compound preferably has the structural element of Formula (I) one after the other repeatedly, wherein each of the repeatedly present groups A or Z or $R^1$ or $R^2$ or $R^3$ can be the same or different.

The term, "acid addition compound" means a saline compound that can be obtained by protonation of basic groups in the molecule, such as especially the optionally present amino groups, for example by treatment with inorganic or organic acids. The acid addition compounds can be added as such or are optionally formed under the conditions of use of the above-defined compounds.

When the polycarbonate-, polyurethane- and/or polyurea-polyorganosiloxane compound comprises —($N^+R^2R^3$)— groupings, then typical counter ions such as for example halide, hydroxide, sulfate, carbonate are present in quantities to ensure the charge neutralization.

The polyorganosiloxane structural element present in the polycarbonate-, polyurethane- and/or polyurea-polyorganosiloxane compounds preferably has the structure $—(SiR^4{}_2O)_p—(SiR^4{}_2)—$, in which $R^4$ is a straight chain, cyclic or branched, saturated, unsaturated or aromatic hydrocarbon group containing up to 20 carbon atoms, and p=1 to 999. The polycarbonate-, polyurethane- and/or polyurea-polyorganosiloxane compounds in the agent preferably comprise at least two, particularly at least three of the cited polyorganosiloxane structural elements. $R^4$ is preferably a straight chain, cyclic or branched, saturated, unsaturated or aromatic $C_1$ to $C_{20}$, in particular a $C_1$ to $C_9$ hydrocarbon group, particularly preferably methyl or phenyl, and p is especially 1 to 199, particularly preferably 1 to 99. In a preferred embodiment all $R^4$ groups are identical.

Preferred inventively used polycarbonate-, polyurethane- and/or polyurea-polyorganosiloxane compounds are linear, i.e. all Y units in the structural element of Formula (I) are each divalent groups. However, branched compounds are also inventively included, in which at least one of the Y groups is tri- or polyvalent, preferably tetravalent, such that branched structures with linear repeat structures are formed from structural elements of Formula (I).

In another embodiment, at least one of the Y units of the structural element of Formula (I) in the inventively used polycarbonate-, polyurethane- and/or polyurea-polyorganosiloxane compound has a $—NR^2—$ grouping and/or at least one of the Y units of the structural element of Formula (I) has a $—(N^+R^2R^3)—$ grouping. In this case $R^2$ and $R^3$ are preferably methyl groups.

Another embodiment relates to the multiple regular occurrence of —O-groupings in at least one of the units Y, $R^1$, $R^2$ and/or $R^3$ of the structural element of Formula (I), preferably in the form of oligoethoxy and/or oligopropoxy groups, wherein their degrees of oligomerization are preferably in the range 2 to 60.

In another preferred embodiment, oligoethylene imine groups are present in at least one of the units Y, $R^1$, $R^2$ and/or $R^3$ of the structural element of Formula (I), wherein their degrees of oligomerization are preferably in the range 10 to 150,000.

Reactive cyclic carbonates and ureas, processes for their manufacture and their reaction with polymeric substrates are described in the international patent application WO 2005/058863. It has now been surprisingly found that not only polycarbonate- and/or polyurethane-polyorganosiloxane compounds accessible from the abovementioned type improve the primary washing power, but also the reactive cyclic carbonates and ureas themselves or polymers obtained from them by reaction with polymeric substrates exhibit the desired effect.

Accordingly, a further subject matter of the invention is the use of compounds of the general formulae IV or V,

IV

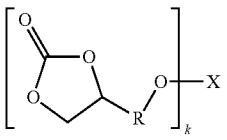

-continued

V

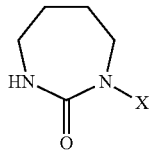

in which

R stands for $C_1$-$C_{12}$ alkylene;

k stands for a number greater than 0,

X stands for $CO—CH{=}CH_2$, $CO—C(CH_3){=}CH_2$, CO—O-aryl, $C_2$-$C_6$ alkylene-$SO_2—CH{=}CH_2$, or $CO—NH—R^1$; and $R^1$ stands for $C_1$-$C_{30}$ alkyl, $C_1$-$C_{30}$ haloalkyl, $C_1$-$C_{30}$ hydroxyalkyl, $C_1$-$C_6$ alkyloxy-$C_1$-$C_{30}$ alkyl, $C_1$-$C_6$ alkylcarbonyloxy-$C_1$-$C_{30}$ alkyl, amino-$C_1$-$C_{30}$ alkyl, mono- or di($C_1$-$C_6$-alkyl)amino-$C_1$-$C_{30}$ alkyl, ammonio-$C_1$-$C_{30}$ alkyl, polyoxyalkylene-$C_1$-$C_{30}$ alkyl, polysiloxanyl-$C_1$-$C_{30}$ alkyl, (meth)acryloyloxy-$C_1$-$C_{30}$ alkyl, sulfono-$C_1$-$C_{30}$ alkyl, phosphono-$C_1$-$C_{30}$ alkyl, di($C_1$-$C_6$ alkyl)-phosphono-$C_1$-$C_{30}$ alkyl, phosphonato-$C_1$-$C_{30}$ alkyl, di($C_1$-$C_6$-alkyl)phosphonato-$C_1$-$C_{30}$ alkyl or a saccharide group, wherein in Formula (I) X only has this meaning when k stands for 1, or X stands for (i) the group of a polyamine on which the part of the formula in brackets is bonded through (CO)NH groups, or (ii) a polymeric structure, on which the part of the formula in brackets is bonded through (CO)—, NH—$C_2$-$C_6$ alkylene-O(CO)— or (CO)—O—$C_2$-$C_6$ alkylene-O(CO)-groups, or (iii) a polymeric structure, on which the part of the formula in brackets is bonded through (CO)-polysiloxanyl-$C_1$-$C_{30}$ alkyl groups, when k stands for a number greater than 1, and/or the polymers that are obtainable by reacting a polymeric substrate that possesses functional groups selected from hydroxyl groups, primary and secondary amino groups, with a compound of the general Formula (IV) or (V), in order to augment the primary washing power of laundry detergents towards oil- and/or fat-containing soils when washing textiles.

Suitable polymeric substrates in connection with the latter aspect of the invention especially include polyvinyl alcohols, polyalkyleneamines such as polyethyleneimines, polyvinylamines, polyallylamines, polyethylene glycols, chitosan, polyamide-epichlorohydrin resins, polyaminostyrenes, polysiloxanes substituted with terminal aminoalkyl groups or with amino alkyl groups in the side chain such as polydimethylsiloxanes, peptides, polypeptides, and proteins as well as mixtures thereof. Particularly preferred polymeric substrates are selected from polyethyleneimines having molecular weights in the range 5 000 to 100 000, in particular 15,000 to 50,000, compounds of the formula $NH_2—[CH_2]_m—(Si(CH_3)_2O)_n—Si(CH_3)_2—[CH_2]_o—R'$, wherein m=1 to 10, preferably 1 to 5, particularly preferably 1 to 3, wherein n=1 to 50, preferably 30 to 50, wherein o=0 to 10, preferably 1 to 5, particularly preferably 1 to 3 and wherein R'=H, $C_{1-22}$ alkyl, an amino or ammonium group, and/or compounds of the formula $NH_2—[CH(CH_3)—CH_2O]_l[CH_2—CH_2O]_m—[CH_2—CH(CH_3)O]_n—R''$, wherein l, m and n independently of each other are numbers from 0 to 50 with the proviso that the sum l+m+n=5 to 100, especially 10 to 50, preferably 10 to 30, particularly preferably 10 to 20, and R"=H, a $C_{1-22}$ alkyl, $C_{1-22}$ aminoalkyl or $C_{1-22}$ ammoniumalkyl group, and mixtures thereof.

The preferred polymers include those that are obtainable by reacting the polymeric substrate with a compound of the general Formula (IV) with k=1 or (V). Further preferred polymers include those that are obtainable by reacting the polymeric substrate with equimolar amounts, with respect to their content of hydroxyl groups, primary and secondary amino groups, of a compound of the general Formula (IV) with k=1 or (V).

The compound of Formula (IV) is preferably selected from
4-phenyloxycarbonyloxymethyl-2-oxo-1,3-dioxolane,
4-(4-phenyloxycarbonyloxy)butyl-2-oxo-1,3-dioxolane,
2-oxo-1,3-dioxolan-4-yl-methyl acrylate,
2-oxo-1,3-dioxolan-4-yl-methyl methacrylate,
4-(2-oxo-1,3-dioxolan-4-yl)-butyl acrylate,
4-(2-oxo-1,3-dioxolan-4-yl)-butyl methacrylate and
4-(vinylsulfonylethyloxy)-butyl-2-oxo-1,3-dioxolane.

Another subject matter of the invention is a process for removing oil- and/or fat-containing soils from textiles in which are used a laundry detergent and a cited active substance (the polycarbonate-, polyurethane- and/or polyurea-polyorganosiloxane compound, the reactive cyclic carbonate or the reactive cyclic urea or the polymer obtained from the latter by reaction with a polymeric substrate). This process can be carried out manually or preferably with the help of a conventional domestic washing machine. Here it is possible to use laundry detergents, in particular containing bleaching agent, and the active substance at the same time or consecutively. Concurrent use can be particularly advantageous when using a laundry detergent that comprises the active substance.

The inventively used active substances can be easily manufactured, as illustrated, and are ecologically and toxicologically harmless. They produce a significantly better removal, in particular of fatty and cosmetic stains on textiles, also on cotton or cotton-containing fabrics, than is the case when using compounds previously known for this purpose. Alternatively, significant amounts of surfactants can be saved for the same fat removing power.

In the context of a washing process, the inventive use can proceed in such a way that the active substance is added to a detergent-containing wash liquor or the active substance is preferably incorporated into the wash liquor as a constituent of the laundry detergent.

Laundry detergents that comprise an active substance to be used according to the invention or are used together with said substance or are employed in the inventive process, can comprise all other conventional components of this type of composition which do not undergo undesirable interactions with the active substance that is essential for the invention. The above-defined active substance is preferably incorporated into the laundry detergent in amounts of 0.01 wt. % to 5 wt. %, especially 0.1 wt. % to 2 wt. %.

It was surprisingly found that these types of active substance positively influence the action of certain other components of laundry detergents and cleaning agents and conversely the action of the fat booster active substance is even further enhanced by certain other laundry detergent components. These effects occur particularly with bleaching agents, with enzymatic agents, particularly proteases and lipases, with water-soluble inorganic and/or organic builders, particularly based on oxidized carbohydrates or polymeric polycarboxylates, with synthetic anionic surfactants of the sulfate and sulfonate type, and with color transfer inhibitors, for example polymers or copolymers of vinyl pyrrolidone, vinyl pyridine or vinyl imidazole or corresponding polybetaines, which is why the addition of at least one of the cited additional ingredients together with the active substance to be inventively used is preferred.

A composition, which comprises an active substance to be used in accordance with the invention or which is used with said substance or is used in the inventive process, preferably comprises bleaching agent based on peroxide, particularly in amounts in the range 5 wt. % to 70 wt. %, as well as optional bleach activators, particularly in amounts in the range 2 wt. % to 10 wt. %. These possible bleaching agents are preferably peroxy compounds generally used in laundry detergents such as percarboxylic acids, for example diperoxy dodecane dioic acid or phthaloylaminoperoxycaproic acid, hydrogen peroxide, alkali metal perborate that can be present as the tetra- or monohydrate, percarbonate, perpyrophosphate and persilicate, which are generally present as the alkali metal salts, particularly as the sodium salts. Such bleaching agents are present in laundry detergents that comprise an active substance used in accordance with the invention, preferably in amounts up to 25 wt. %, particularly up to 15 wt. % and particularly preferably from 5 wt. % to 15 wt. %, each based on the total composition, wherein percarbonate in particular is incorporated. The optionally present components of the bleach activators include the customarily used N- or O-acyl compounds, for example polyacylated alkylenediamines, particularly tetraacetylethylenediamine, acylated glycolurils, in particular tetraacetyl glycoluril, N-acylated hydantoins, hydrazides, triazoles, urazoles, diketopiperazines, sulfuryl amides and cyanurates, also carboxylic acid anhydrides, particularly phthalic anhydride, carboxylic acid esters, particularly sodium isononanoyl phenol sulfonate, and acylated sugar derivatives, in particular pentaacetylglucose, as well as cationic nitrile derivatives such as trimethylammonium acetonitrile salts. In order to avoid interaction with the peroxy compounds during storage, the bleach activators can be coated or granulated in a known manner with coating materials, wherein tetraacetylethylenediamine granulated with the help of carboxymethyl cellulose with mean particle sizes of 0.01 mm to 0.8 mm, granulated 1,5-diacetyl-2,4-dioxohexahydro-1,3,5-triazine, and/or trialkylammonium acetonitrile produced in particle form is particularly preferred. The laundry detergents preferably comprise these types of bleach activators in amounts of up to 8 wt. %, particularly 2 wt. % to 6 wt. %, each based on the total composition.

In a preferred embodiment, an inventive or inventively used composition or a composition employed in the inventive process comprises non-ionic surfactant, selected from fatty alkyl polyglycosides, fatty alkyl polyalkoxylates, especially ethoxylates and/or propoxylates, fatty acid polyhydroxyamides and/or ethoxylated and/or propoxylated products of fatty alkylamines, vicinal diols, fatty acid alkyl esters and/or fatty acid amides as well as their mixtures, especially in an amount in the range 2 wt. % to 25 wt. %.

A further embodiment of this type of composition includes the presence of synthetic anionic surfactants of the sulfate and/or sulfonate type, especially fatty alkyl sulfate, fatty alkyl ether sulfate, sulfofatty acid ester and/or di-salts of sulfofatty acids, especially in an amount in the range 2 wt. % to 25 wt. %. The anionic surfactant is preferably selected from the alkyl or alkenyl sulfates and/or the alkyl or alkenyl ether sulfates, in which the alkyl or alkenyl group has 8 to 22, particularly 12 to 18 carbon atoms. These are not usually single substances, but are rather fractions or mixtures. Among these are preferred those whose content of compounds having longer chain groups in the range 16 to 18 carbon atoms is more than 20 wt. %.

The possible non-ionic surfactants include the alkoxylates, especially the ethoxylates and/or propoxylates of saturated or mono to polyunsaturated linear or branched alcohols containing 10 to 22 carbon atoms, preferably 12 to 18 carbon atoms. Generally, the degree of alkoxylation of the alcohol is between 1 and 20, preferably between 3 and 10. They can be manufactured in a known manner by treating the relevant alcohol with the relevant alkylene oxides. The derivatives of the fatty alcohols are particularly suitable, although their branched isomers, particularly the so-called oxo alcohols, can also be employed for manufacturing useable alkoxylates. Accordingly, the alkoxylates, especially the ethoxylates, of primary alcohols containing linear, especially dodecyl, tetradecyl, hexadecyl or octadecyl groups as well as their mixtures can be used. Moreover, corresponding alkoxylation products of alkylamines, vicinal diols and carboxylic acid amides, which in regard to the alkyl moiety correspond to the cited alcohols can be used. Furthermore, the ethylene oxide and/or propylene oxide insertion products of alkyl esters of fatty acids as well as polyhydroxyamides of fatty acids can be considered. Suitable alkyl polyglycosides for incorporation into the inventive compositions are compounds of the general formula $(G)_n$-$OR^{12}$, in which $R^{12}$ means an alkyl or alkylene group with 8 to 22 carbon atoms, G a glycose unit and n means a number between 1 and 10. The glycoside components $(G)_n$ concern oligomers or polymers of naturally occurring aldose or ketose monomers, which particularly include glucose, mannose, fructose, galactose, talose, gulose, altrose, allose, idose, ribose, arabinose, xylose and lyxose. The oligomers consisting of this type of glycosidically linked monomers are characterized not only by the type of sugar comprised in them but also by their number, the "degree of oligomerization". The degree of oligomerization n generally assumes fractional numbers for the analytically determined value; it is between 1 and 10 and for the preferably employed glycosides is below a value of 1.5, particularly between 1.2 and 1.4. Glucose, due to favorable availability, is the preferred monomer building block. The alkyl or alkenyl moiety $R^{12}$ of the glycosides is also preferably derived from easily available derivatives of renewable raw materials, especially from fatty alcohols, although their branched isomers, particularly the so called oxo alcohols, can also be employed for manufacturing suitable glycosides. Accordingly, especially the primary alcohols with linear, octyl, decyl, dodecyl, tetradecyl, hexadecyl or octadecyl groups as well as their mixtures can be used. Particularly preferred alkyl glycosides comprise a coco fat alkyl ester group, i.e. mixtures essentially having $R^{12}$=dodecyl and $R^{12}$=tetradecyl.

Compositions that comprise an inventively used active substance which are inventively used or which are employed in the inventive process comprise non-ionic surfactant, preferably in amounts of 1 wt. % to 30 wt. %, particularly 1 wt. % to 25 wt. %, wherein quantities in the upper part of this range are more likely to be encountered in liquid laundry detergents, and granular laundry detergents preferably comprise rather lower quantities of up to 5 wt. %.

The compositions can, instead or in addition, comprise further surfactants, preferably synthetic anionic surfactants of the sulfate or sulfonate type, such as for example alkylbenzene sulfonates, in amounts of preferably not more than 20 wt. %, particularly 0.1 wt. % to 18 wt. %, each based on the total composition. As particularly suitable synthetic anionic surfactants for use in these types of compositions may be cited the alkyl and/or alkenyl sulfates containing 8 to 22 carbon atoms, which carry an alkali metal, ammonium or alkyl or hydroxyalkyl substituted ammonium ion as the counter ion. The derivatives of fatty alcohols containing especially 12 to 18 carbon atoms and their branched analogs, the so-called oxo alcohols, are preferred. The alkyl and alkenyl sulfates can be manufactured in a known manner by treating the corresponding alcohol components with a conventional sulfating reagent, particularly sulfur trioxide or chlorosulfonic acid, followed by neutralization with alkali metal-, ammonium- or alkyl- or hydroxyalkyl-substituted ammonium bases. The suitable surfactants of the sulfate type also include the sulfated alkoxylation products of the cited alcohols, the so-called ether sulfates. Preferably, such ether sulfates comprise 2 to 30, particularly 4 to 10 ethylene glycol groups per molecule. The suitable anionic surfactants of the sulfonate type include the α-sulfoesters obtained by treating fatty acid esters with sulfur trioxide and subsequent neutralization, especially the sulfonation products derived from fatty acids containing 8 to 22 carbon atoms, preferably 12 to 18 carbon atoms, and linear alcohols containing 1 to 6 carbon atoms, preferably 1 to 4 carbon atoms, as well as those obtained by formal saponification of these abovementioned sulfofatty acids.

As further optional surfactant-like ingredients, one can consider soaps, wherein saturated fatty acid soaps are suitable, such as the salts of lauric acid, myristic acid, palmitic acid or stearic acid as well as soaps derived from natural fatty acid mixtures such as coconut oil fatty acid, palm kernel oil fatty acid or tallow fatty acid. Those soap mixtures are particularly preferred that are composed of 50 wt. % to 100 wt. % of saturated $C_{12}$-$C_{18}$ fatty acid soaps and up to 50 wt. % of oleic acid soap. Preferably, soap is comprised in amounts of 0.1 wt. % to 5 wt. %. However, particularly in liquid compositions that comprise an active substance used in accordance with the invention, higher amounts of soap, generally up to 20 wt. %, can also be comprised.

The compositions can also, when desired, comprise betaines and/or cationic surfactants, which—when present—are preferably added in amounts of 0.5 wt. % to 7 wt. %. Among these, the esterquats, discussed below, are particularly preferred.

In a further embodiment, the composition comprises water-soluble and/or water-insoluble builders, particularly selected from alkali metal alumosilicate, crystalline alkali metal silicate with a modulus greater than 1, monomeric polycarboxylate, polymeric polycarboxylate and their mixtures, especially in amounts in the range of 2.5 wt. % to 60 wt. %.

The composition preferably comprises 20 wt. % to 55 wt. % of water-soluble and/or water-insoluble, organic and/or inorganic builder. The water-soluble organic builders particularly include those from the class of the polycarboxylic acids, particularly citric acid and sugar acids, as well as the polymeric (poly)carboxylic acids, particularly the polycarboxylates that can be obtained by oxidation of polysaccharides, polymeric acrylic acid, methacrylic acid, maleic acid and mixed polymers thereof, which can also comprise minor amounts of copolymerized polymerizable substances that are free of carboxylic acid functionality. The relative molecular weight of the homopolymers of unsaturated carboxylic acids lies generally between 5000 and 200,000, that of the copolymers between 2000 and 200,000, preferably 50,000 to 120,000, based on the free acid. A particularly preferred acrylic acid-maleic acid copolymer has a relative molecular weight of 50,000 to 100,000. Suitable, yet less preferred compounds of this class, are copolymers of acrylic acid or methacrylic acid with vinyl ethers, such as vinyl methyl ethers, vinyl esters, ethylene, propylene and styrene, in which the content of the acid is at least 50 wt. %. Terpolymers, which comprise two unsaturated acids and/or their salts as monomers as well as vinyl alcohol and/or an esterified vinyl alcohol or a carbohydrate as the third monomer, can also be used as water-soluble organic builders. The first acid monomer or its salt is derived from a monoethylenically unsaturated $C_3$-$C_8$ carboxylic acid and preferably from a $C_3$-$C_4$ monocarboxylic acid, particularly from (meth)acrylic acid. The second acid monomer or its salt can be a derivative of a $C_4$-$C_8$ dicarboxylic acid, maleic acid being particularly preferred. In this case the third monomer unit is formed from vinyl alcohol and/or preferably an esterified vinyl alcohol. In particular, vinyl alcohol derivatives are preferred which represent an ester of short chain carboxylic acids, for example $C_1$-$C_4$ carboxylic acids with vinyl alcohol. Preferred terpolymers comprise 60 wt. % to 95 wt. %, particularly 70 wt. % to 90 wt. % (meth) acrylic acid or (meth)acrylate, particularly preferably acrylic acid or acrylate, and maleic acid or maleate as well as 5 wt. % to 40 wt. %, preferably 10 wt. % to 30 wt. % vinyl alcohol and/or vinyl acetate. Terpolymers are quite particularly preferred, in which the weight ratio (meth)acrylic acid or (meth) acrylate to maleic acid or maleate is between 1:1 and 4:1, preferably between 2:1 and 3:1 and particularly 2:1 and 2.5:1. Here, both the quantities and the weight ratios are based on the acids. The second acid monomer or its salt can also be a derivative of an allyl sulfonic acid, which is substituted in the 2-position with an alkyl group, preferably a $C_1$-$C_4$ alkyl group, or an aromatic group that is preferably derived from benzene or benzene derivatives. Preferred terpolymers comprise 40 wt. % to 60 wt. %, particularly 45 wt. % to 55 wt. % (meth)acrylic acid or (meth)acrylate, particularly preferably acrylic acid or acrylate, 10 wt. % to 30 wt. %, preferably 15 wt. % to 25 wt. % methallyl sulfonic acid or methallyl sulfonate and as the third monomer 15 wt. % to 40 wt. %, preferably 20 wt. % to 40 wt. % of a carbohydrate. This carbohydrate can, for example, be a mono, di, oligo or polysaccharide, mono, di or oligosaccharides being preferred, saccharose being particularly preferred. Adding the third monomer presumably creates intended weak points in the polymer, which are responsible for the good biological degradation of the polymer. In general, the terpolymers possess a relative molecular weight between 1000 and 200,000, preferably between 200 and 50,000 and particularly between 3000 and 10,000. They can be added, especially for the manufacture of liquid compositions, in the form of aqueous solutions, preferably in the form of 30 to 50 weight percent aqueous solutions. In general, all the cited polycarboxylic acids are added in the form of their water-soluble salts, particularly their alkali metal salts.

Such organic builders are preferably comprised in amounts of up to 40 wt. %, particularly up to 25 wt. % and particularly preferably from 1 wt. % to 5 wt. %. Amounts close to the cited upper limit are preferably incorporated in pasty or liquid, particularly aqueous compositions.

In particular, crystalline or amorphous alkali metal aluminosilicates in amounts of up to 50 wt. %, preferably not more than 40 wt. % and in liquid agents not more than 1 wt. % to 5 wt. % are added as the water-insoluble, water-dispersible inorganic builders. Among these, the detergent-quality crystalline sodium aluminosilicates, particularly zeolite NaA and optionally NaX, are preferred. Amounts close to the cited upper limit are preferably incorporated in solid, particulate compositions. Suitable aluminosilicates particularly exhibit no particles with a particle size above 30 μm and preferably consist of at least 80 wt. % of particles smaller than 10 μm. Their calcium binding capacity, which can be determined according to the indications of German patent DE 24 12 837, lies in the range 100 to 200 mg CaO per gram. Suitable substitutes or partial substitutes for the cited aluminosilicate are crystalline alkali metal silicates that can be alone or present in a mixture with amorphous silicates. The alkali metal silicates that can be used as builders in the inventive compositions preferably have a molar ratio of alkali metal oxide to $SiO_2$ below 0.95, particularly 1:1.1 to 1:12 and can be amorphous or crystalline. Preferred alkali metal silicates are the sodium silicates, particularly the amorphous sodium silicates, with a molar ratio $Na_2O:SiO_2$ of 1:2 to 1:2.8. These types of amorphous alkali metal silicates are commercially available for example under the name Portil®. Those with a molar ratio $Na_2O:SiO_2$ of 1:1.9 to 1:2.8 are preferably added as solids and not in the form of a solution in the context of manufacturing. Crystalline silicates that can be present alone or in a mixture with amorphous silicates are preferably crystalline, layered silicates corresponding to the general formula $Na_2Si_xO_{2x+1}yH_2O$, wherein x, the so-called modulus is a number from 1.9 to 4 and y is a number from 0 to 20, preferred values for x being 2, 3 or 4. Crystalline layered silicates, which correspond to this general formula, are described, for example, in the European patent application EP 0 164 514. Preferred crystalline layered silicates are those in which x assumes the values 2 or 3 in the cited general formula. Both β- and δ-sodium disilicates ($Na_2Si_2O_5$ $yH_2O$) are preferred. Practically anhydrous crystalline alkali metal silicates of the abovementioned general formula, in which x is a number from 1.9 to 2.1 can also be manufactured from amorphous alkali metal silicates, and can be used in compositions that comprise active substances to be used according to the invention. In a further preferred embodiment of the composition according to the invention, a crystalline sodium layered silicate with a modulus of 2 to 3 is added, as can be manufactured from sand and soda. In another preferred embodiment of laundry detergents that comprise an inventively used active substance, crystalline sodium silicates with a modulus in the range 1.9 to 3.5 are added. Their content of alkali metal silicates is preferably in the range 1 wt. % to 50 wt. % and particularly 5 wt. % to 35 wt. %, based on the anhydrous active substance. For the case that alkali metal aluminosilicate, particularly zeolite, is also present as an additional builder, then the content of alkali metal silicate is preferably in the range 1 wt. % to 15 wt. % and particularly 2 wt. % to 8 wt. %, based on the anhydrous active substance. The weight ratio of aluminosilicate to silicate, each based on anhydrous active substances, is then preferably 4:1 to 10:1. In agents that comprise both amorphous and crystalline alkali metal silicates, the weight ratio of amorphous alkali metal silicate to crystalline alkali metal silicate is preferably 1:2 to 2:1 and particularly 1:1 to 2:1.

In addition to the cited inorganic builders, further water-soluble or water-insoluble inorganic substances can be incorporated into the compositions that comprise an active substance to be used with them in accordance with the invention or in inventive processes. In this context, the alkali metal carbonates, alkali metal hydrogen carbonates and alkali metal sulfates as well as their mixtures are suitable. This type of additional inorganic material can be present in amounts of up to 70 wt. %.

In addition, the compositions can comprise further conventional ingredients of laundry detergents and cleaning agents. These optional ingredients particularly include enzymes, enzyme stabilizers, complexants for heavy metals, for example amino polycarboxylic acids, amino hydroxypolycarboxylic acids, polyphosphonic acids and/or amino polyphosphonic acids, foam inhibitors, for example organopolysiloxanes or paraffins, solvents, and optical brighteners, for example stilbene sulfonic acid derivatives. Preferably, the compositions that comprise an active substance used in accordance with the invention, comprise up to 1 wt. %, particularly 0.01 wt. % to 0.5 wt. % optical brightener, particularly compounds from the class of the substituted 4,4'-bis-(2,4,6-triamino-s-triazinyl)-stilbene-2,2'-disulfonic acids, up to 5 wt. %, particularly 0.1 wt. % 2 wt. % complexants for heavy metals, particularly aminoalkylene phosphonic acids and their salts, and up to 2 wt. %, particularly 0.1 wt. % to 1 wt. % foam inhibitors, wherein the cited weight fractions are each based on the total composition.

Solvents that in particular can be added to liquid compositions are, besides water, preferably those that are miscible with water. They include the lower alcohols, for example ethanol, propanol, iso-propanol, and the isomeric butanols, glycerine, lower glycols, for example ethylene and propylene glycol, and the ethers that can be derived from the cited classes of compounds. The active substances used in accordance with the invention are generally dissolved in such liquid combinations or are present in the form of a suspension.

Enzymes that are optionally present are preferably selected from the group that includes protease, amylase, lipase, cellulase, hemicellulases, oxidase, peroxidase or their mixtures. Protease isolated from microorganisms, such as bacteria and fungi, are considered first and foremost. They are obtained by means of fermentation processes from suitable microorganisms in a manner known per se. Proteases are commercially available, for example, under the trade names BLAP®, Savinase®, Esperase®, Maxatase®, Optimase®, Alcalase®, Durazym® or Maxapem®. The suitable lipase can be obtained for example from *Humicola lanuginosa*, from *Bacillus* types, from *Pseudomonas* types, from *Fusarium* types, from *Rhizopus* types or from *Aspergillus* types. Suitable lipases are commercially available, for example, under the trade names Lipolase®, Lipozym®, Lipomax®, Amano®-Lipase, Toyo-Jozo®-Lipase, Meito®-Lipase and Diosynth®-Lipase. Suitable amylase are commercially available, for example, under the trade names Maxamyl®, Termamyl®, Duramyl® and Purafect® OxAm. Suitable cellulase can be an isolated enzyme from bacteria or fungi and exhibits a pH optimum preferably in the weakly acidic to weakly alkaline region of 6 to 9.5. These types of cellulases are commercially available under the trade names Celluzyme®, Carezyme® and Ecostone®.

The conventional enzyme stabilizers that are optionally present, particularly in liquid compositions, include amino alcohols, for example mono-, di-, triethanolamine and mono-, di-, tripropanolamine and their mixtures, lower carboxylic acids, boric acid or alkali metal borates, boric acid carboxylic acid combinations, boric acid esters, boronic acid derivatives, calcium salts, for example the Ca formic acid combination, magnesium salts, and/or sulfur-containing reducing agents.

The suitable foam inhibitors include long chain soaps, especially behenic soap, fatty acid amides, paraffins, waxes, microcrystalline waxes, organopolysiloxanes and their mixtures, which can moreover comprise microfine, optionally silanized or otherwise hydrophobized silica. For use in particulate compositions, such foam inhibitors are preferably bound on granular, water-soluble carriers.

In a preferred embodiment, a composition, into which an active substance used in accordance with the invention has been incorporated, is in particulate form and comprises up to 25 wt. %, particularly 5 wt. % to 20 wt. % bleaching agent, especially alkali metal percarbonate, up to 15 wt. %, particularly 1 wt. % to 10 wt. % bleach activator, 20 wt. % to 55 wt. % inorganic builder, up to 10 wt. %, particularly 2 wt. % to 8 wt. % water-soluble organic builder, 10 wt. % to 25 wt. % synthetic anionic surfactant, 1 wt. % to 5 wt. % non-ionic surfactant and up to 25 wt. %, particularly 0.1 wt. % to 25 wt. % inorganic salts, especially alkali metal carbonate and/or alkali metal hydrogen carbonate.

In a further preferred embodiment, a composition, into which active substance used in accordance with the invention is incorporated, is in liquid form and comprises 10 wt. % to 25 wt. %, particularly 12 wt. % to 22.5 wt. % non-ionic surfactant, 2 wt. % to 10 wt. %, particularly 2.5 wt. % to 8 wt. % synthetic anionic surfactant, 3 wt. % to 15 wt. %, particularly 4.5 wt. % to 12.5 wt. % soap, 0.5 wt. % to 5 wt. %, particularly 1 wt. % to 4 wt. % organic builder, especially polycarboxylate such as citrate, up to 1.5 wt. %, particularly 0.1 wt. % to 1 wt. % complexant for heavy metals, such as phosphonate, and besides optionally enzyme, enzyme stabilizers, colorants and/or fragrance as well as water and/or water-miscible solvent.

The well known active polyester soil-release polymers that can be additionally incorporated in the inventively essential active substances include copolyesters of dicarboxylic acids, for example adipic acid, phthalic acid or terephthalic acid, diols, for example ethylene glycol or propylene glycol, and polydiols, for example polyethylene glycol or polypropylene glycol. The preferred soil release polyesters employed include such compounds that are formally obtained by the esterification of two monomeric moieties, wherein the first monomer is a dicarboxylic acid HOOC-Ph-COOH and the second monomer is a diol $HO—(CHR^{11}—)_a)_bOH$ that can also be present as the polymeric diol $H—(O—(CHR^{11}—)_a)_bOH$. Here, Ph means an o-, m- or p-phenylene group that can carry 1 to 4 substituents selected from alkyl groups with 1 to 22 carbon atoms, sulfonic acid groups, carboxyl groups and their mixtures, $R^1$ is hydrogen, an alkyl group with 1 to 22 carbon atoms and their mixtures, a is a number from 2 to 6 and b is a number from 1 to 300. Preferably, both monomer diol units $—O—(CHR^{11}—)_aO—$ and also polymeric diol units $—(O—(CHR^{11}—)_a)_bO—$ are present in the resulting polyesters. The molar ratio of monomeric diol units to polymeric diol units is preferably in the range 100:1 to 1:100, particularly 10:1 to 1:10. The degree of polymerization b of the polymeric diol units is preferably in the range 4 to 200, particularly 12 to 140. The molecular weight or the average molecular weight or the maximum of the molecular weight distribution of preferred soil-releasing polyesters is in the range 250 to 100,000, particularly 500 to 50 000. The acid based on the Ph group is preferably selected from terephthalic acid, isophthalic acid, phthalic acid, trimellitic acid, mellitic acid, the isomers of sulfo phthalic acid, sulfo isophthalic acid and sulfo terephthalic acid and their mixtures. As long as their acid groups are not part of the ester linkages in the polymer, then they are preferably present in salt form, particularly as the alkali metal or ammonium salt. Among these, sodium and potassium salts are particularly preferred. If desired, instead of the monomer HOOC-Ph-COOH, small amounts, particularly not more than 10 mol % of other acids that possess at least two carboxyl groups, based on the fraction of Ph with the abovementioned meaning, can be comprised in the soil release polyester. Exemplary alkylene and alkenylene dicarboxylic acids include malonic acid, succinic acid, fumaric acid, maleic acid, glutaric acid, adipic acid, pimelic acid, suberic acid, azelaic acid and sebacic acid. The preferred diols $HO—(CHR^{11}—)_aOH$ include those in which $R^{11}$ is hydrogen and a is a number from 2 to 6, and those in which a has the value 2 and $R^{11}$ is selected from hydrogen and alkyl groups with 1 to 10, particularly 1 to 3 carbon atoms. The last named diols are particularly preferably those of the formula $HO—CH_2—CHR^{11}—OH$, in which $R^{11}$ has the abovementioned meaning. Exemplary diol components are ethylene glycol, 1,2-propylene glycol, 1,3-propylene glycol, 1,4-butane diol, 1,5-pentane diol, 1,6-hexane diol, 1,8-octane diol, 1,2-decane diol, 1,2-dodecane diol and neopentyl glycol. Polyethylene glycol with an average molecular weight of 1000 to 6000 is particularly preferred among the polymeric diols.

If desired, the polyesters constituted as described above can be end blocked, wherein the blocking groups can be alkyl groups with 1 to 22 carbon atoms and esters of monocarboxylic acids. The end groups bonded through ester linkages can be based on alkyl, alkenyl and aryl monocarboxylic acids containing 5 to 32 carbon atoms, particularly 5 to 18 carbon atoms. They include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselic acid, petroselaidic acid, oleic acid, linoleic acid, linolaidic acid, linolenic acid, elaiostearic acid, arachic acid, gadoleic acid, arachidonic acid, behenic acid, erucic acid, brassidic acid, clupanodonic acid, lignoceric acid, cerotic acid, melissic acid, benzoic acid that can carry 1 to 5 substituents with a total of up to 25 carbon atoms, particularly 1 to 12 carbon atoms, for example tert.-butylbenzoic acid. The end groups can also be based on hydroxymonocarboxylic acids containing 5 to 22 carbon atoms, examples of which include hydroxyvaleric acid, hydroxycaproic acid, ricinoleic acid, its hydrogenation product hydroxystearic acid, and o-, m- and p-hydroxybenzoic acid. The hydroxymonocarboxylic acids can themselves be linked with one another through their hydroxyl group and their carboxyl group and thus be present several fold in an end group. Preferably, the number of hydroxymonocarboxylic acid units per end group, i.e., their degree of oligomerization, is in the range 1 to 50, particularly 1 to 10. In a preferred development of the invention, polymers of ethylene terephthalate and polyethylene oxide terephthalate are used, in which the polyethylene glycol units have a molecular weight of 750 to 5000 and the molar ratio of ethylene terephthalate to polyethylene oxide terephthalate is 50:50 to 90:10, in combination with an inventively essential active substance.

The soil release polymers are preferably water-soluble, wherein the term "water-soluble" should be understood to mean a solubility of at least 0.01 g, preferably at least 0.1 g of the polymer per liter water at room temperature and pH 8. Under these conditions however, preferably employed polymers exhibit a solubility of at least 1 g per liter, particularly at least 10 g per liter.

EXAMPLES a) Washing Conditions

Washing machine: Miele W 918

Wash program: Soak whites/coloreds program

Wash temperature: 40° C.

Volume of wash liquor: 17 l

Water hardness: 16° DH

Amount of laundry: 3.5 kg clean washing incl. test fabrics (pillows, shirts, dish cloths, barley corn cloths)

b) Procedure

The test textiles provided with standardized fat and oil soils were washed three times under the conditions listed above with a laundry detergent that comprised one of the above-described active substances, and after washing dried in air. The evaluation was by colorimetric analysis.

Detergent Composition [Wt. %]:

| | E1 | E2 | E3 |
|---|---|---|---|
| $C_{12-14}$ fatty alcohol with 7 EO | 5 | 4 | 10 |
| $C_{9-13}$ alkylbenzene sulfonate, Na salt | 10 | 10 | 10 |
| Sodium lauryl ether sulfate with 2 EO | — | — | 8 |
| Active substance | 1 | 1 | 1 |
| Polyacrylate thickener | — | — | 1 |
| Sodium percarbonate | 15 | 18 | — |
| TAED | 3 | 3 | — |
| $C_{12-18}$ fatty acid, Na salt | 1 | 1.5 | 7.5 |
| PVA/Maleic acid copolymer | 4.5 | 2 | — |
| Citric acid, Na salt | 2.5 | — | 2 |
| Phosphonic acid, Na salt | 0.5 | 0.5 | 1 |
| Sodium carbonate | 10 | 20 | — |
| Propane diol | — | — | 6.5 |
| Zeolite A | 25 | 25 | — |
| Boric acid, Na salt | — | — | 1.2 |
| Silicone defoamer | 2.5 | 1.3 | 0.1 |
| Enzymes (Amylase, Protease, Cellulase) | + | + | + |
| Colorant | + | + | + |
| Perfume | 0.5 | 0.2 | 0.8 |
| Water | — | — | ad 100 |
| Sodium sulfate | — | ad 100 | — |
| Sodium bicarbonate | ad 100 | — | — |

The laundry detergents with an active substance to be used according to the invention showed a significantly better washing power than the otherwise identical composition without the active substance.

What is claimed is:

1. A method, wherein the method comprises washing a textile provided with oil- and fat-containing soil with a laundry detergent comprising at least one component selected from the group consisting of bleaching agents, enzymatic agents, water-soluble inorganic builders, water-soluble organic builders, synthetic anionic sulfate surfactants, synthetic anionic sulfonate surfactants, and color transfer inhibitors in the presence of at least one polycarbonate-, polyurethane- and/or polyurea-polyorganosiloxane compound, comprising at least one structural element of Formula (I):

$$—Y-A-(C{=}O)-A- \quad (I),$$

wherein each A is independently selected from S, O or $NR^1$, Y is a di- or polysubstituted, straight chain, cyclic or branched, saturated, unsaturated or aromatic substituted or unsubstituted hydrocarbon group containing up to 1000 carbon atoms not counting the carbon atoms of an optionally comprised polyorganosiloxane unit which can comprise one or more groups, selected from —O—, —(CO)—, —NH—, —$NR^2$—, —($N^+R^2R^3$)— or a polyorganosiloxane unit containing 2 to 1000 silicon atoms, wherein at least one of the Y units according to the structural element of Formula (I) possesses an —($N^+R^2R^3$)— grouping, $R^1$ is hydrogen or a straight chain, cyclic or branched, saturated, unsaturated or aromatic hydrocarbon group containing up to 40 carbon atoms which can comprise one or more groups, selected from —O—, —(CO)—, —NH— or —$NR^2$—, $R^2$ is a straight chain, cyclic or branched, saturated, unsaturated or aromatic hydrocarbon group containing up to 40 carbon atoms which can comprise one or more groups selected from —O—, —(CO)— or —NH—, $R^3$ is a straight chain, cyclic or branched, saturated, unsaturated or aromatic hydrocarbon group containing up to 100 carbon atoms which can comprise one or more groups, selected from —O—, —(CO)—or —NH—, or is a divalent group that forms a cyclic structure within the Y group, or one or both A groups neighboring Y can form a nitrogen-containing heterocyclic group with the group Y located between them, and in the overall compound not all of the groups A or Y or $R^1$ or $R^2$ or $R^3$ listed in Formula (I) have to be the same, with the proviso that in the overall compound at least one of the groups Y comprises a polyorganosiloxane unit having 2 to 1000 silicon atoms, and/or an acid addition compound and/or salt thereof, whereby the primary washing power of the laundry detergent is enhanced by the at least one polycarbonate-, polyurethane and/or polyurea-polyorganosiloxane compound and/or acid addition compound and/or salt thereof.

2. The method according to claim 1, wherein the polyorganosiloxane unit present in the polycarbonate-, polyurethane- and/or polyurea-polyorganosiloxane compound has the structure $—(SiR^4{}_2O)_p—(SIR^4{}_2)—$, in which $SiR^4{}_2$ is a straight chain, cyclic or branched, saturated, unsaturated or aromatic hydrocarbon group containing up to 20 carbon atoms, and p=1 to 999.

3. The method according to claim 1, wherein the polycarbonate-, polyurethane- and/or polyurea-polyorganosiloxane compound comprises at least two polyorganosiloxane units.

4. The method according to claim 1, wherein one or more oligoethoxy- and/or oligopropoxy groups, having degrees of oligomerization in the range 2 to 60, are present in at least one of the units Y, $R^1$, $R^2$ and/or $R^3$ according to the structural element of Formula (I).

5. The method according to claim 1, wherein one or more oligoethylene imine groups, having degrees of oligomerization in the range 10 to 150,000, are present in at least one of the units Y, $R^1$, $R^2$ and/or $R^3$ according to the structural element of Formula (I).

6. The method according to claim 1, wherein the polycarbonate-, polyurethane- and/or polyurea-polyorganosiloxane compound comprises at least one structural element of Formula (II) or of Formula (III):

$$-A-Y-A-(CO)—O-Z-(CHOH)-Z-O—(CO)— \quad (II),$$

$$-A-Y-A-(CO)—O—(CHCH_2OH)-Z-O—(CO)— \quad (III),$$

in which A and Y have the meanings cited for Formula (I) in claim 1 and Z is a divalent, straight chain, cyclic or branched, saturated or unsaturated, optionally substituted hydrocarbon group containing 1 to 12 carbon atoms.

7. The method according to claim 1, wherein the laundry detergent comprises 0.01 wt. % to 5 wt. % of the polycarbonate-, polyurethane- and/or polyurea-polyorganosiloxane compound and/or acid addition compound and/or salt thereof.

8. The method according to claim 1, wherein the washing is carried out in a washing liquor into which the polycarbonate-, polyurethane- and/or polyurea-polyorganosiloxane compound and/or acid addition compound and/or salt thereof has been incorporated as a constituent of the laundry detergent.

9. The method according to claim 1, wherein the laundry detergent comprises at least one surfactant, at least one bleaching agent and/or enzyme, and at least one builder.

10. The method according to claim 1, wherein the laundry detergent comprises at least one enzymatic agent selected from the group consisting of proteases and lipases.

11. The method according to claim 1, wherein the laundry detergent comprises at least one organic builder selected from the group consisting of oxidized carbohydrates and polymeric polycarboxylates.

12. The method according to claim 1, wherein the laundry detergent comprises at least one color transfer inhibitor selected from the group consisting of polymers and copolymers of vinyl pyrrolidone, vinyl pyridine, vinyl imidazole and the corresponding polybetaines.

13. The method according to claim 1, wherein the laundry detergent comprises at least one peroxide bleaching agent.

14. The method according to claim 1, wherein the laundry detergent comprises at least one synthetic anionic sulfate or sulfonate surfactant, at least one peroxide bleaching agent and/or at least one protease or lipase enzyme, and at least one water-soluble organic builder.

* * * * *